US008561913B2

(12) United States Patent
Peteri et al.

(10) Patent No.: US 8,561,913 B2
(45) Date of Patent: Oct. 22, 2013

(54) DEVICE FOR DISPENSING WATER WITH VARIABLE TEMPERATURES

(75) Inventors: Niels Theodoor Peteri, Rotterdam (NL); Ivo Legel, Bergschenhoek (NL)

(73) Assignee: Henri Peteri Beheer B.V., Ridderkerk (NL)

( * ) Notice: Subject to any disclaimer, the term of this patent is extended or adjusted under 35 U.S.C. 154(b) by 1123 days.

(21) Appl. No.: 12/443,996

(22) PCT Filed: Oct. 3, 2007

(86) PCT No.: PCT/NL2007/000251

§ 371 (c)(1),
(2), (4) Date: Apr. 2, 2009

(87) PCT Pub. No.: WO2008/041841

PCT Pub. Date: Apr. 10, 2008

(65) Prior Publication Data

US 2010/0006658 A1 Jan. 14, 2010

(30) Foreign Application Priority Data

Oct. 3, 2006 (NL) ..... 1032610

(51) Int. Cl.
*G05D 23/13* (2006.01)

(52) U.S. Cl.
USPC ..... 236/12.1; 236/12.11; 236/12.12; 236/12.15; 236/20 R; 236/25 R; 392/441; 392/449

(58) Field of Classification Search
USPC ..... 236/12.1, 12.11, 12.12, 12.15, 20 R, 236/25 R; 392/441, 449
See application file for complete search history.

(56) References Cited

U.S. PATENT DOCUMENTS

| | | | | |
|---|---|---|---|---|
| 4,480,173 | A | 10/1984 | Butterfield | |
| 5,093,897 | A | 3/1992 | Peteri et al. | |
| 6,315,210 | B1 * | 11/2001 | Kline | 236/12.2 |
| 6,837,443 | B2 * | 1/2005 | Saitoh et al. | 237/2 B |

FOREIGN PATENT DOCUMENTS

| | | | |
|---|---|---|---|
| CN | 1217051 | A | 5/1995 |
| CN | 2502177 | Y | 7/2002 |
| CN | 2828612 | Y | 10/2006 |
| DE | 3224321 | A1 | 4/1982 |

(Continued)

OTHER PUBLICATIONS

English Machine Translation of DE 3124321 A1.
English Machine Translation of DE 19503741 A1.
English Machine Translation of DE 69020679 T2.
English Abstract of JP 60-259840 A.

(Continued)

*Primary Examiner* — Marc Norman
*Assistant Examiner* — Jonathan Bradford
(74) *Attorney, Agent, or Firm* — Hoffmann & Baron, LLP

(57) ABSTRACT

A device for dispensing water includes a water tank for keeping water at a tank temperature higher than the desired temperature of the water to be dispensed. A tank inlet is connected to a source of water. device includes a mixing device with a first water supply, a second water supply and a water discharge connected to a dispensing point. The first water supply is connected to a hot water pipe originating from a central hot water source arranged at a distance, and the second water supply is connected to a tank outlet. The mixing device includes a control device which is designed to mix water from the first and second water supply in such a manner that the water to be dispensed substantially has a desired temperature.

17 Claims, 4 Drawing Sheets

(56) References Cited

FOREIGN PATENT DOCUMENTS

| | | | |
|---|---|---|---|
| DE | 69020679 | T2 | 4/1996 |
| DE | 195 03 741 | A1 | 8/1996 |
| DE | 19503741 | A1 | 8/1996 |
| EP | 0 422 738 | A1 | 4/1991 |
| FR | 2 671 170 | A1 | 7/1992 |
| JP | 60-259840 | A | 12/1985 |
| JP | 60-259840 | A2 | 12/1985 |
| JP | S61-153339 | A | 7/1986 |
| JP | S61-155462 | U | 9/1986 |
| JP | 61276655 | A | 12/1986 |
| JP | S61-276655 | A | 12/1986 |
| JP | 3194329 | A | 8/1991 |
| JP | H3-194329 | A | 8/1991 |
| JP | 8094104 | A | 4/1996 |
| JP | 2003294306 | A | 10/2003 |
| TW | 388494 | U | 4/2000 |
| WO | 92/12689 | A1 | 7/1992 |

OTHER PUBLICATIONS

English Machine Translation of WO 92/12389 A1.

Office Action for Japanese Patent Application No. 2009-531331, mailed Jul. 4, 2012.

English Machine Translation for JP 2003294306, dated Oct. 1, 2012.

English Machine Translation for JP 8094104, dated Oct. 2, 2012.

Japanese Office Action Dated May 22, 2013 for a counterpart for foreign application.

Communication from a foreign (Taiwan) patent office for a counterpart foreign application, dated Apr. 22, 2012.

English translation of the communication from a foreign (Taiwan) patent office for a counterpart foreign application, dated Apr. 22, 2012.

English (machine) translation of CN2502177.

English (machine) translation of CN2828612.

English (machine) translation of CN1217051.

English Bibliographic Data for TW 388494.

* cited by examiner

DEVICE FOR DISPENSING WATER WITH VARIABLE TEMPERATURES

CROSS-REFERENCE TO RELATED APPLICATIONS

This application is the National Stage of International Application No. PCT/NL2007/000251, filed Oct. 3, 2007, which claims the benefit of Netherlands Application No. NL 1032610, filed Oct. 3, 2006, the contents of which is incorporated by reference herein.

FIELD OF THE INVENTION

The present invention relates to a device and method for dispensing water with variable temperatures.

FIELD OF THE INVENTION

A device of this type is suitable for supplying hot water, in particular in the kitchen. Such a device comprises a preferably electrically heated tank which is connected to a cold water pipe, if desired by means of accessories. The volume of the tank can be relatively small, for example at most 20 liters, preferably at most 8 liters, and in this type of embodiment is mainly suitable for household kitchens or small professional kitchens.

In a particular embodiment, the water tank keeps water at a temperature which is above the atmospheric boiling point. This very hot water can be dispensed via a first outlet to a mixing device which mixes the water with water from a cold water pipe in order to provide water of a desired starting temperature which is below the atmospheric boiling point of water. Via a second outlet, the water can be dispensed as boiling water.

A similar device is known from EP 0 422 738 B1. This known device is an alternative compared to a known central water heater placed at a distance from a dispensing point, such as a central heating boiler or a large boiler which are usually placed in lofts or in cellars or at other locations inside or outside a house, at a distance from a kitchen or other tapping point.

Compared to such a central water heater, the known device according to EP 0 422 738 B1 has the advantage that pipe losses and the associated waste of energy, water and time are eliminated. At the same time, the known device offers the possibility, by means of another outlet, of dispensing boiling water in addition to hot or warm water.

However, the known device has the drawback that it comprises a small tank—volumes in the order of magnitude of at most 20 liters are mentioned. In practice, many users have found this limited volume to be inconvenient, despite the fact that the drawbacks mentioned of the central water heater have been solved.

At the same time, the known device has the drawback that the provision of boiling water may be disrupted if too much hot water has been used.

In addition, retrofitting the known device has the drawback that the existing hot water pipe is often shut off at the position where the device is installed, for example in the kitchen. Thus, a relatively long dead-end branch of a hot water pipe remains in place. As a result thereof, there is a significant risk of colonies of legionella forming in such a dead-end branch, which could form a health risk.

It should be noted that it is possible, in principle, to shut off the hot water pipe at a fork, in order to eliminate the dead-end branch in the hot water pipe, but in practice this often results in structural disturbances as the fork is situated, for example, behind a tiled wall in a bathroom. Shutting off the hot water pipe at the fork can thus lead to significant costs and labour, which does not make installing or retrofitting the known device attractive.

SUMMARY OF THE INVENTION

It is an object of the invention to provide a device for hot water which eliminates one or more of the abovementioned drawbacks.

This object is achieved by a device for dispensing water according to the present invention.

By providing a mixing device to a device for dispensing water according to the present invention, the following becomes possible. When the user opens, for example, a tap connected to the tapping point for hot or warm water, relatively cold water, i.e. water which has cooled down in the hot water pipe, will flow from the hot water pipe to the mixing device. As this water does not have the desired minimum temperature, the control device will mix water from the water tank having a temperature higher than the desired temperature of the water to be dispensed with the water from the hot water pipe in order to achieve the desired predetermined temperature in the order of magnitude of, for example, 40-65° C.

After some time, the water from the hot water pipe will gradually become hot as the new hot water from the central water heater reaches the device, with the mixing device gradually reducing the supply of very hot water from the tank and eventually stopping it completely. Since the mixing device is provided with a temperature-sensitive control element, the user will experience a constant hot water temperature, in combination with the convenience of an unlimited supply of immediately hot water.

In the case of a control position of the control device in which either only water from the first or from the second water supply is allowed to pass through, according to the invention the mixing is controlled by the control device and no actual mixing of water from both water supplies takes place.

The control device of the mixing device can be any suitable control device which is able to mix the water coming from the hot water pipe and the water coming from the water tank in order to mix water in a specific desired ratio. For example, the control means may comprise valves which are operated by means of thermostat controls. It is also possible to provide electrically operated valves in the first and second water supply which are controlled on the basis of the inlet and outlet temperatures.

It should be noted that so-called "hot fill" kitchen boilers are known. These are small boilers which are not connected to the cold water pipe, but to a hot water pipe which is fed by a central water heater, such as a central heating boiler or large boiler. In view of the fact that a kitchen boiler is used in order to solve the problem of pipe losses, the designation "hot fill" is actually incorrect, as initially cold water flows into the device, which cold water comes from the cooled-down hot water pipe which connects the central water heater to the boiler. This has three significant drawbacks.

Firstly, this results in a great fluctuation in the temperature of the tap water. After all, this will initially be the temperature of the boiler tank, but as more cold water flows in, the tap water temperature will fall significantly, and then it will increase again when hot water from the central water heater reaches the tapping point through the kitchen boiler. In this connection, it is a disadvantage that the volume of this "hot fill" boiler has to be relatively large in order to limit the great temperature fluctuations at least to some degree. And finally, this system is the worst possible solution from the point of view of energy efficiency: the substantial stationary losses of the kitchen boiler are combined with the heat loss due to the hot water pipe of the central water heater to the kitchen boiler cooling off. In addition, the central water heater will switch itself on whenever an amount of water is drawn off in the kitchen, however small.

Furthermore, "hot-fill" boilers have the drawback that they are filled with water which has already been kept at a certain high temperature for some time in a central heating boiler or large boiler. This renders the water less suitable for human consumption. Using the present invention, the residence time is significantly reduced when the water tank is filled with fresh cold water from a cold water pipe. The water from such an embodiment is therefore more suitable for human consumption.

DE 195 03741 A1 describes an example of a "hot-fill" system. In this case, the (cooled-down) water initially flows from the hot water pipe through the boiler to the dispensing point. As soon as this water has reached the desired temperature, it is immediately passed from the hot water pipe to the hot water dispensing point by means of a three-way valve via a bypass. However, there is no mention of the desired temperature of the dispensed hot water being controlled and no mixing device is provided.

By according to the invention heating the water from the water tank to a temperature higher than the desired hot water temperature, and mixing this with the water which has cooled down in the pipe, the volume of water from the water tank which is required in order to increase the temperature of the cooled-down water from the pipe to the desired starting temperature is smaller. Consequently, it is possible to provide a smaller tank which is advantageous in particular when used in a kitchen or bathroom.

Preferably, the tank temperature is at least 15° C., and more preferably at least 25° C., hotter than the desired temperature of the water to be dispensed. In absolute figures, the tank temperature is preferably at least 95° C.

In one embodiment, the tank temperature is above the atmospheric boiling temperature of water.

The device comprises a second tank outlet which is directly connected to a tapping point for very hot, i.e. hotter than 95° C., or boiling water, i.e. in that case the tank temperature is equal to or greater than the atmospheric boiling temperature of water.

As described in the introduction, such tapping points are advantageously provided in, for example, a kitchen so that it is possible to dispense, in addition to cold water, also warm or hot water via a first tapping point and very hot or boiling water via a second tapping point by means of the device according to the invention.

The device is connected to both a cold water pipe and a hot water pipe. A cold water pipe can be used to fill the tank with cold water. Furthermore, the cold water can be used to cool water which originates from the hot water source and is hotter than the desired temperature down to the desired temperature by means of an automatic mixing device. Preferably, this automatic device is the first mixing device.

In one embodiment, the water tank is vacuum-insulated. This is particularly desirable with a device according to the invention as the possible heat losses are relatively large, due to the water temperature in the water tank which is significantly higher than that of conventional boilers.

In one embodiment of the device with a three-way valve, the system is made still more energy-efficient. For small amounts of hot water, the user can opt to switch the connection with the hot water pipe to the cold water pipe. This offers the advantage that the central water heater does not have to be switched on which is undesirable from the point of view of energy efficiency when small amounts are dispensed. This could also take place automatically by means of a control means which switches a three-way valve as a function of, for example, time, quantity or flow rate.

In principle, it is not essential for the apparatus according to the invention whether the water temperature in the tank is above or below the atmospheric boiling point. Obviously, the higher this temperature is, the more the volume of the tank can be reduced, as more cold water can be admixed in order to achieve the same desired tap water temperature. In embodiments in which the water temperature in the tank exceeds the atmospheric boiling point, it is desirable to incorporate a boiling point cut-out between the tank and the hot water tap, so that no water can flow out of the hot water tap on account of the vapour pressure in case the water pressure on the main pipe drops away. This boiling point cut-out may react to pressure, temperature, flow, etc.

The invention furthermore relates to a method for dispensing water of a certain desired minimum dispensing temperature at a dispensing point according to the present invention.

According to another aspect of the invention, the invention provides a device for dispensing warm, hot and/or boiling water, which is provided with a boiling point cut-out, which prevents boiling water from being dispensed from the warm or hot water tapping point when the water pressure in the hot water pipe and/or the cold water pipe drops away.

DETAILED DESCRIPTION OF PREFERRED EMBODIMENTS

Below, a number of embodiments of the invention are described by way of example without this being intended as a complete overview of all conceivable variants.

Figure 1:
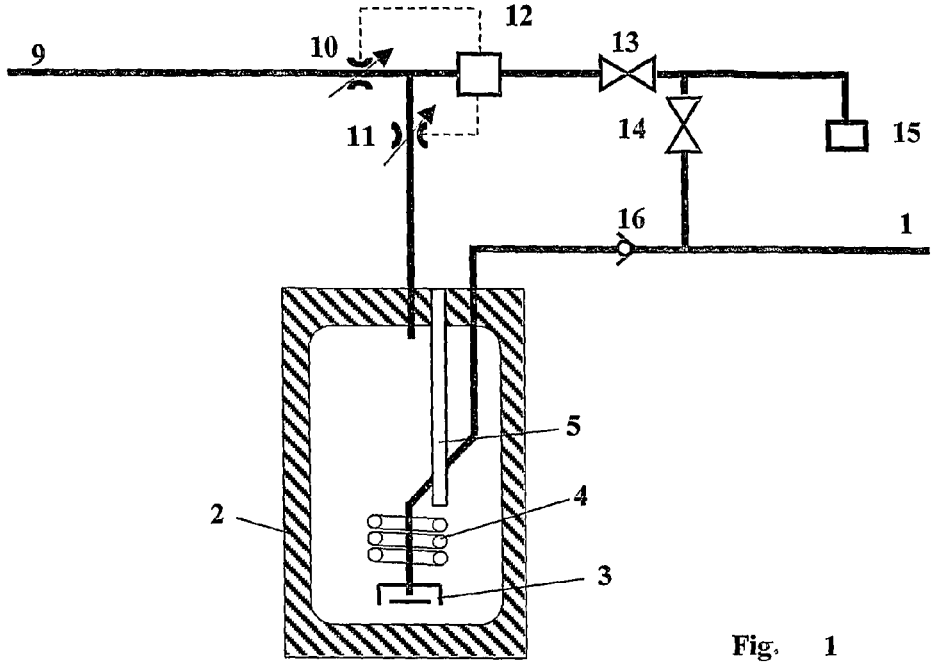
FIG. 1 shows an embodiment of a device according to the invention.

FIG. 1 shows an example of a device. FIG. 1 shows a water tank (2) for keeping water at a certain tank temperature. An inlet point (3) for fresh water is provided in order to allow fresh water to enter the water tank (2). In the tank (2), cold water which has entered via inlet point (3) from the cold water pipe (1) is heated to a temperature above the atmospheric boiling point of water by means of a preferably electrical heating element (4). Usually, a preferably electrical heating element which can heat the water in the water tank to the tank temperature is provided to this end. A thermostat control having a temperature sensor (5) or other control means may be provided for keeping the water in the water tank at the tank temperature.

The tank temperature is preferably higher than 85° C., more preferably 95° C. A controllable valve (11) is arranged in the outlet line of the water tank (2) upstream of the connection to a hot water pipe (9) coming from a central water heater (not shown). A controllable valve (10) is arranged in the hot water pipe (9). Downstream of the mixing device, the hot water pipe (9) runs to a hot water tap (13). A control device (12) is provided in order to actuate the controllable valves (10), (11) on the basis of a water temperature measured in the hot water pipe (9).

When water is drawn off through the tap outlet (15) by means of the hot water tap (13), cold water from cold water pipe (1) will simultaneously flow into the tank (2). The control device (12) will, by means of the controllable valves (10 and 11), mix the water from a hot water pipe (9) originating from a central water heater (not shown) which has for the most part cooled down with hot water from the water tank (2), in such a manner that the temperature set on the control device (12) is achieved, for example 50-70° C., preferably 60° C. This set temperature will in practice preferably correspond to the temperature set in the central water heater. This hot water can subsequently be mixed again with cold water which is dispensed via the tap (14) so that water of a desired temperature is dispensed at the outlet (15). The taps (13) and (14) in practice often form a mixer tap, for example a thermostat tap.

The mixing device (10, 11, 12) can, if required, also serve as a boiling point cut-out, in case the water pressure in the main water pipe drops away. To this end, the valve (11) is closed if the water pressure drops away in the hot water pipe (9), so that the hot water from the tank cannot flow out of the tap (13) when the latter is opened. Furthermore, the backflow protection, in the form of non-return valve (16), serves as boiling point cut-out in case the pressure in the cold water pipe drops away.

FIGS. 2 and 4 to 7 show embodiments of a device according to the invention. Similar parts are denoted by identical reference numerals.

Figure 2:
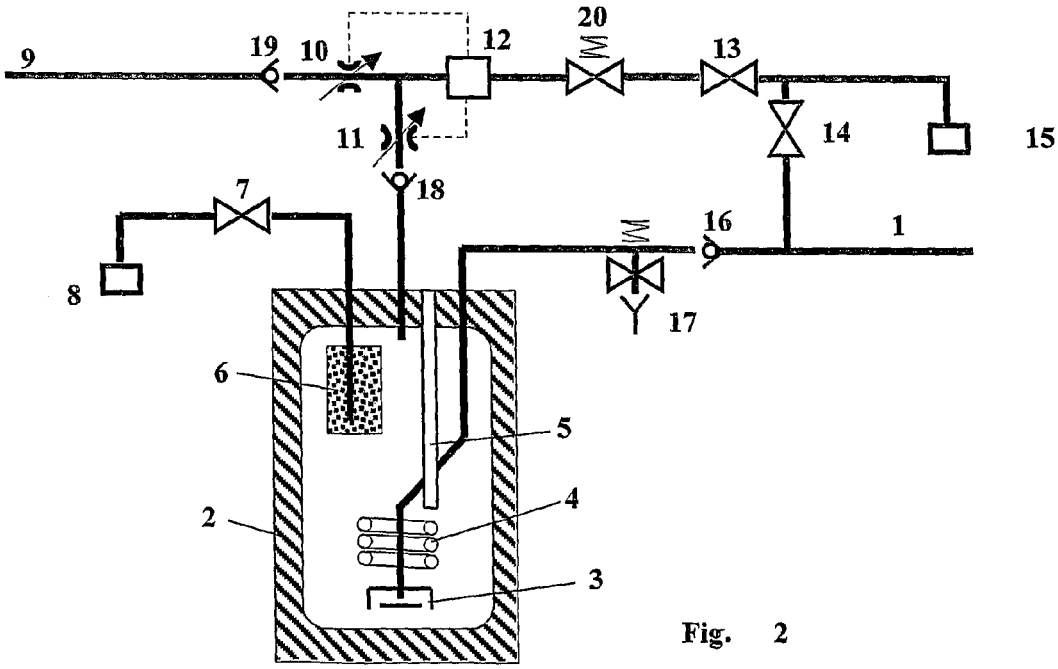
FIG. 2 shows an embodiment in which a water tank is provided with a shut-off valve.

FIG. 2 shows an embodiment in which the water tank (2) is furthermore provided with a shut-off valve (7) for hot or boiling water by means of which water can be drawn off via a tapping point for (very) hot or boiling water via an outlet (8) for very hot or boiling water. In order to dispense boiling water, the tank temperature has to be above the atmospheric boiling point of water. The hot water can in this case be purified by means of an active carbon filter (6). The device is furthermore provided with a number of backflow protection units (16, 18, 19) and a pressure-relief feature (17). The backflow protection units (16) and (19) ensure that no water will flow back into the cold or hot water pipe, respectively, as a result of expansion due to heating. The backflow protection unit (18) prevents any water from entering the tank (1) at the top when hot or boiling water is drawn off via shut-off valve (7).

FIG. 2 also shows a pressure-sensitive boiling point cut-out (20), which prevents boiling water from undesirably flowing out via the tapping point for warm or hot water from the outlet (15) when the hot water tap (13) is opened while there is no pressure in the cold water pipe (1). This outflow will occur on account of the vapour pressure which is present when the tank (2) is heated to a temperature above the atmospheric boiling point. The pressure-sensitive boiling point cut-out is a valve which is closed when the pressure in the system drops below a predetermined value. This value will have to be between the vapour pressure of the water in tank (2), i.e. 100-200 kPa (abs.) and the water pressure normally present in the cold water pipe of approx. 300-400 kPa (abs.). Embodiments in which the boiling point cut-out reacts to temperature, flow, etc. are likewise possible.

Figure 3:
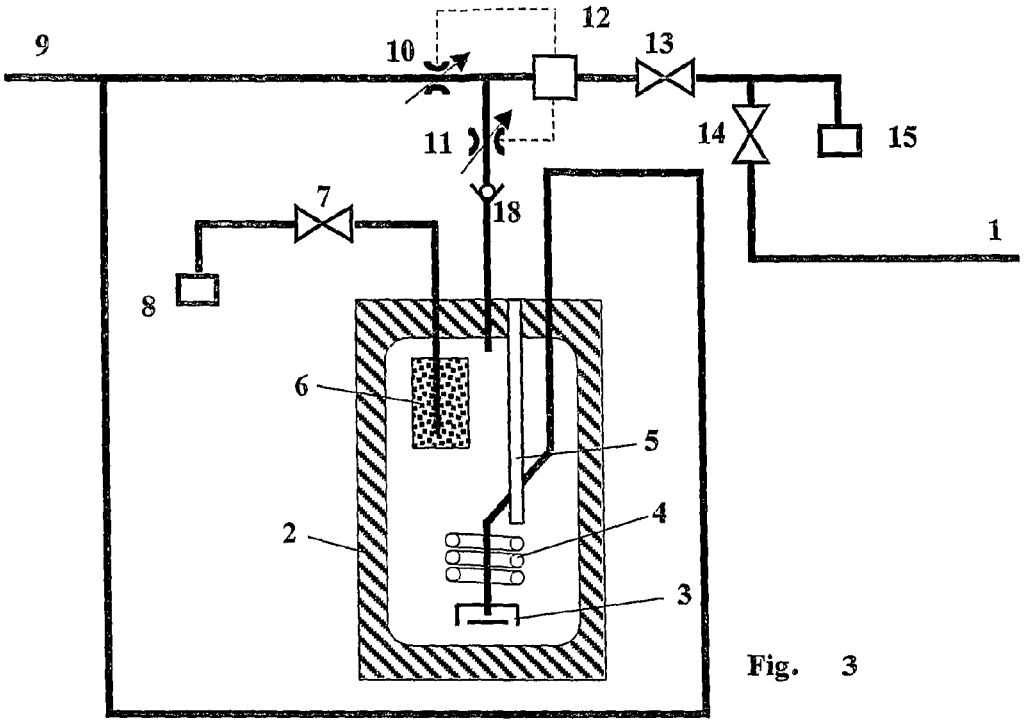
FIG. 3 shows an embodiment in which a tank is filled with water from a hot water pipe.

FIG. 3 shows an embodiment in which the tank (2) is filled with water from the hot water pipe (9) rather than with cold water. The control device (12) again ensures the correct tap water temperature by opening or closing the controllable valves (10) and (11). The backflow protection unit (18) prevents hot water from flowing in at the top of the tank, which is undesirable, when hot or boiling water (8) is drawn off.

Figure 4:
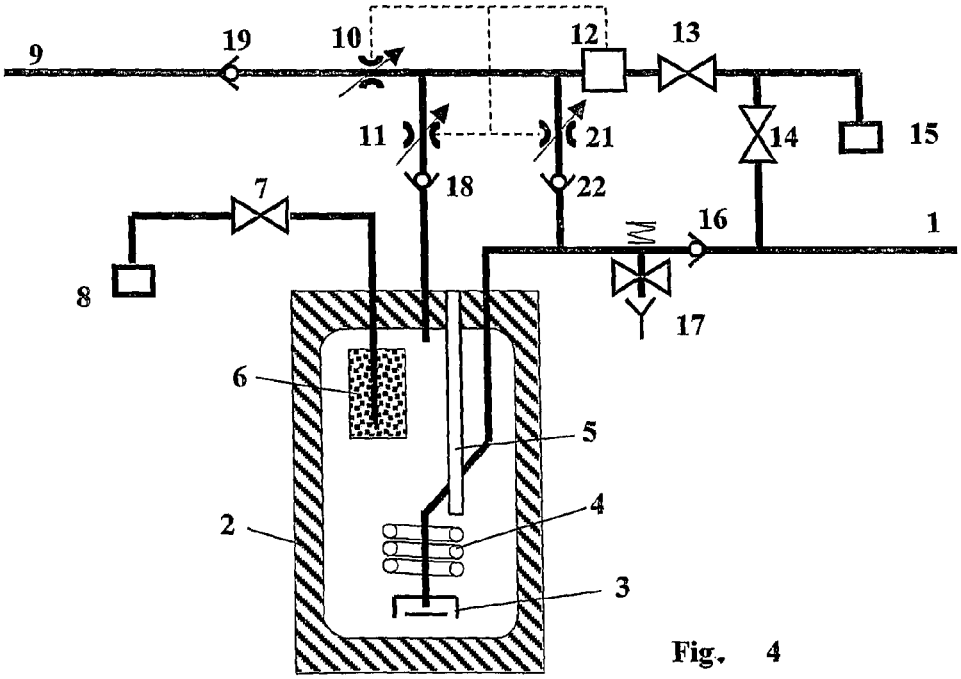
FIG. 4 shows an embodiment in which a temperature-sensitive control device controls the supply of water from a hot water pipe.

FIG. 4 shows an embodiment in which a temperature-sensitive control device (12) controls the supply of water from the hot water pipe (9) by means of the controllable valve (10), in combination with water from the tank (2) by means of the controllable valve (11). This embodiment has an additional connection between the shut-off valve (13) for hot water and the cold water pipe (1) via the controllable valve (21). This valve is also connected to the control device (12), as a result of which it is possible to obtain water of any desired temperature between cold and the temperature of tank (2) via the hot water tap (13). As a result thereof, it is possible to set the desired starting temperature of the control device lower than the starting temperature of the central water heater. The mixing device (10, 11, 12, 21) can also serve as boiling point cut-out when the pressure in the cold water pipe (1) drops away.

Figure 5:
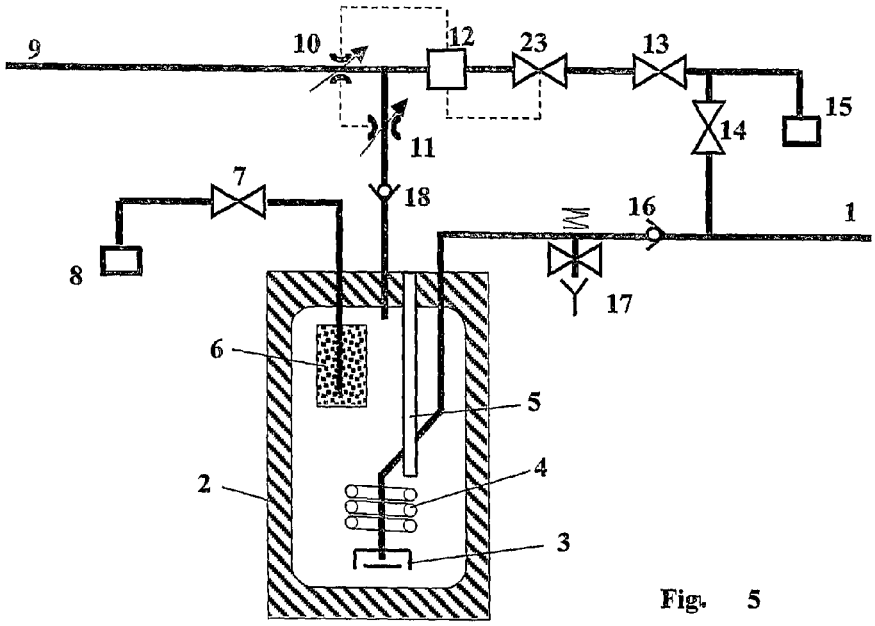
FIG. 5 shows an embodiment in which a control device ensures that an additional valve is shut off, when desired.

FIG. 5 shows an embodiment in which the control device (12) furthermore ensures that an additional valve (23) is shut off if the water temperature becomes excessive when hot water is drawn off via the hot water tap (13).

Figure 6:
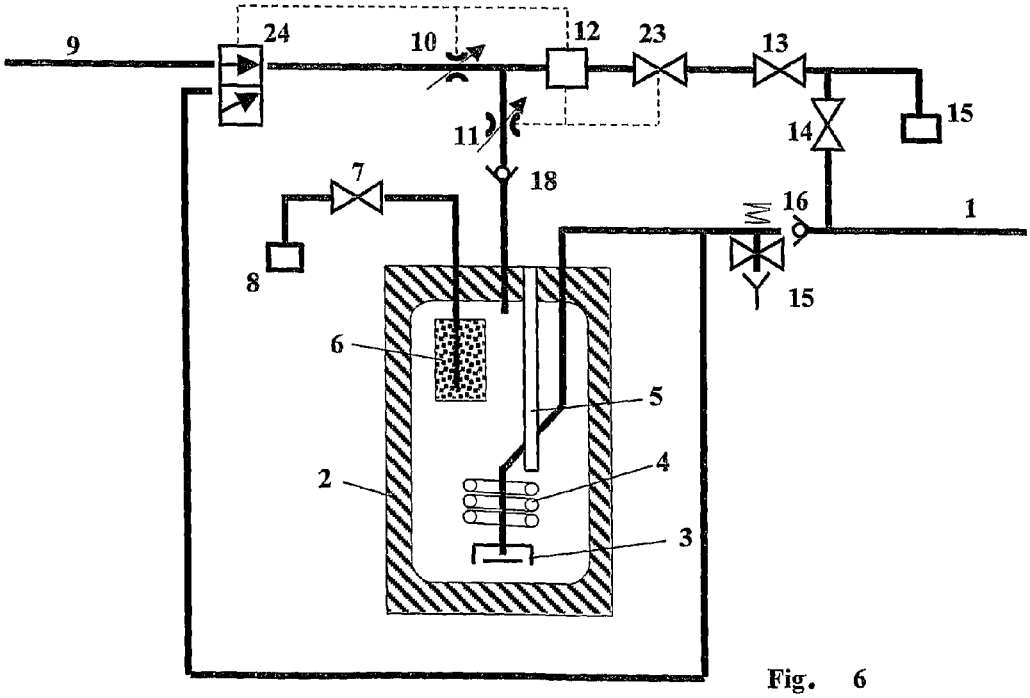
FIG. 6 shows an embodiment which makes it possible to supply water from a hot water pipe or a cold water pipe to a controllable valve.

FIG. 6 shows an embodiment which makes it possible to supply water from the hot water pipe (9) or the cold water pipe (1) to the controllable valve (10). The switching between these water supplies is carried out by the three-way valve (24). The apparatus according to the invention and the central water heater together will consequently use substantially less energy than in other embodiments. If little hot tap water is required via the hot water tap (13), it is sensible not to load the external central water heater which is connected to the hot water pipe (9). The three-way valve (24) can be set to the desired position manually by the user, but can also be actuated by means of the control device (12) or a further automatic operating unit.

Figure 7:
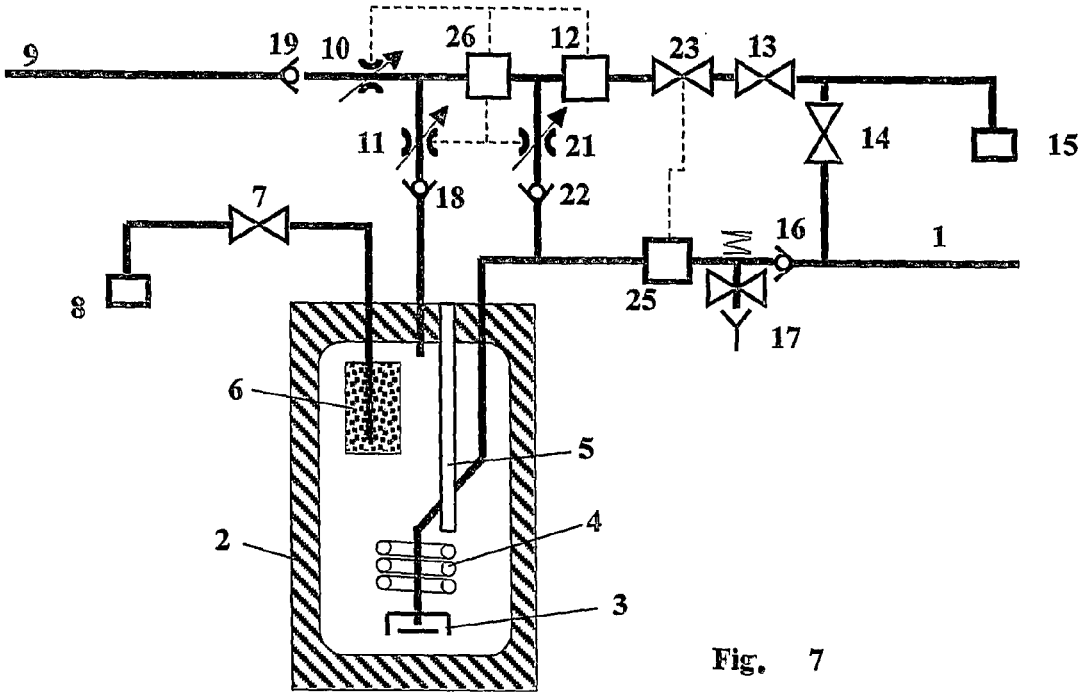
FIG. 7 shows an embodiment which comprises two temperature-sensitive control units.

FIG. 7 shows an embodiment which comprises two temperature-sensitive control units (26, 12) which measure the hot tap water temperature for the hot water tapping point (15) at two different positions and adjust the temperature until it reaches the desired temperature of use. Three controllable valves (10, 11, 21) ensure that the three water supplies, i.e. the hot water pipe (9), the hot or boiling water supply from the tank (2) and the cold water pipe (1), are mixed correctly. A pressure-sensitive sensor (25) ensures that the shut-off valve (23) shuts off the supply to the hot water tapping point (15) when the pressure in the cold water pipe (1) drops away.

The invention claimed is:

1. A device for dispensing water, comprising:

a water tank comprising a heating means and a thermostat for heating the water in the water tank and for keeping water at a tank temperature, which water tank comprises a tank inlet and a tank outlet, in which the tank inlet is to be connected to a source of water, wherein the device comprises a mixing device with a first water supply, a second water supply and a water discharge, in which the first water supply is to be connected to a hot water pipe originating from a central hot water source, the second water supply is connected to the tank outlet, and the water discharge is to be connected to a dispensing point close to the water tank relative to the hot water source, wherein the mixing device comprises a temperature-sensitive control device which is designed to mix water from the first and second water supply to compensate for cooled down water in the hot water pipe between the hot water source and the mixing device in such a manner that the water to be dispensed at the dispensing point substantially immediately has a desired temperature, and in which the tank temperature is higher than the desired temperature of the water to be dispensed, wherein the tank temperature is at least 95° C., wherein the water tank is provided with a second tank outlet which is connected to a tapping point for very hot or boiling water, and wherein the source of water is a cold water pipe.

2. The device according to claim 1, wherein the tank temperature is above the atmospheric boiling temperature of water.

3. The device according to claim 1, wherein the mixing device comprises a third water supply which is connected to a cold water pipe, and in which the control device is designed to mix the water from the first, second and third water supply in such a manner that the water to be dispensed substantially has a desired temperature in case the temperature of the water of the hot water pipe is higher than the desired temperature.

4. The device according to claim 1, wherein the desired temperature is substantially equal to the starting temperature of the hot water source.

5. The device according to claim 1, wherein the mixing device comprises a thermostatic control having electrically operated valves.

6. The device according to claim 1, wherein the device comprises a second mixing device which is connected to the water discharge of the first mixing device and to a cold water pipe.

7. The device according to claim 6, wherein the second mixing device is a kitchen tap.

8. The device according to claim 1, wherein the first water supply of the mixing device comprises a valve, which comprises a first position in which the first water supply is supplied with water from the hot water pipe and a second position in which the water supply is supplied with water from a cold water pipe.

9. The device according to claim 8, wherein the valve is an automatically operated valve, in which the choice between the first position and the second position is dependent on the amount of hot water in the water tank.

10. The device according to claim 8, wherein the valve is an automatically operated valve, in which the choice between the first position and the second position is dependent on the amount of hot water drawn off.

11. The device according to claim 8, wherein the valve can be operated manually by the user.

12. The device according to claim 1, wherein a shut-off valve is arranged between the tank outlet and the second water supply or in the tank outlet, which shut-off valve is designed to shut off the tank outlet when the pressure in the hot water pipe drops away.

13. The device according to claim 12, wherein the shut-off valve is formed by a valve of the control device in the second water supply.

14. The device according to claim 1, wherein a shut-off valve is arranged in the tank inlet, which shut-off valve is designed to shut off the tank inlet when the pressure in the water source drops away.

15. A method for dispensing water of varied temperatures comprising:

providing the device of claim 1, dispensing an amount of water from a hot water pipe which is connected to a central hot water source, and if the temperature of the water to be dispensed from the hot water pipe is lower than a desired minimum dispensing temperature, mixing the water from the hot water pipe with water which originates from the water tank which is close to the dispensing point relative to the hot water source and which contains water of a higher temperature than the desired minimum temperature, to achieve the desired temperature, wherein the tank inlet is connected to a cold water pipe.

16. The method according to claim 15, in which the method further comprises:

mixing water from a cold water pipe if the temperature of the water to be dispensed from the hot water pipe, optionally mixed with the water from the water tank, is higher than the desired minimum dispensing temperature.

17. A water supply system for dispensing water of variable temperatures comprising:

the device of claim 1, a central hot water source, a hot water pipe connecting the central hot water source with the first water supply of the device, a cold water pipe connected to the tank inlet, and a dispensing point for warm or hot water connected to the discharge of the mixing device.

* * * * *